United States Patent [19]

Sequeira

[11] Patent Number: 4,689,585

[45] Date of Patent: Aug. 25, 1987

[54] DIELECTRIC SLAB SIGNAL ISOLATORS

[75] Inventor: Hermann B. Sequeira, Baltimore, Md.

[73] Assignee: Martin Marietta Corporation, Bethesda, Md.

[21] Appl. No.: 801,534

[22] Filed: Nov. 27, 1985

Related U.S. Application Data

[63] Continuation-in-part of Ser. No. 683,535, Dec. 19, 1984.

[51] Int. Cl.[4] ..... H01P 1/37

[52] U.S. Cl. ..... 333/24.2; 333/248

[58] Field of Search ..... 333/24.2, 236, 239, 333/245, 248; 350/96.14

[56] References Cited

U.S. PATENT DOCUMENTS

| | | | |
|---|---|---|---|
| 3,386,787 | 6/1968 | Kaplan | 333/239 X |
| 3,986,147 | 10/1976 | Carter et al. | 333/24.2 X |
| 4,034,377 | 7/1977 | Knox et al. | 333/24.2 X |
| 4,093,345 | 6/1978 | Logan et al. | 350/96.14 X |
| 4,459,567 | 7/1984 | Stern et al. | 333/24.2 |
| 4,490,700 | 12/1984 | Stern et al. | 333/239 X |

*Primary Examiner*—Paul Gensler

*Attorney, Agent, or Firm*—Gay Chin; James B. Eisel

[57] ABSTRACT

A transmission line comprising a multi-layer dielectric slab structure including: a dielectric substrate layer (30) having a thickness $d_s$ and permittivity $\epsilon_s$; a conductive ground plane (31) on the bottom surface of the dielectric substrate layer (30); a dielectric guiding layer (32) having a thickness h and permittivity $\epsilon_g$, where $\epsilon_g > \epsilon_s$, attached to the top surface of dielectric substrate layer (30); at least one elongated and relatively narrow dielectric loading strip layer (33) having a width W, thickness $d_1$, and permittivity $\epsilon_1$, where $\epsilon_g > \epsilon_1$, attached to the top surface of the dielectric guiding layer (32); and a conductive coating (34) on the top surface of the dielectric loading strip layer (32). Such a structure permits single mode propagation over a relatively wide band. Radiation losses due to coupling of the desired mode to the substrate modes and the conductors are furthermore reduced and the polarization of the dominant mode is such as to render said structure relatively insensitive to small deviations from parallelism among the different interfaces. This invention is directed to multi-layer dielectric slab structures implemented in the form of a signal isolator.

7 Claims, 25 Drawing Figures

DIELECTRIC SLAB SIGNAL ISOLATORS

CROSS REFERENCE TO RELATED APPLICATION

This application is a continuation in part of prior co-pending application Ser. No. 06/683,535, filed in the name of Hermann Brian Sequeira on Dec. 19, 1984 for "A Compound Dielectric Multi-Conductor Transmission Line".

BACKGROUND OF THE INVENTION

This invention relates generally to high frequency transmission lines and more particularly to planar type waveguide structures for millimeter wave applications.

Guided wave transmission lines are widely used to channel the flow of high-frequency electrical energy. Common examples of these transmission lines are the coaxial line, the hollow metallic waveguide and the optical fiber. All these waveguiding structures are useful in long link applications. However, in situations where the distance between the transmitting and receiving points is below a few inches, as in an integrated circuit, planar transmission lines offer an attractive alternative to these types of transmission lines. A variety of planar transmission line configurations are possible.

In one type of planar transmission line, metallic conductors play a primary role in the waveguiding process. This includes the well known microstrip transmission line, the slotline, the coplanar waveguide, and coplanar strip line. In another type of planar transmission line, a dielectric strip plays a primary role in the waveguiding process. This includes the well known dielectric strip guide and the inverted strip guide. typical examples of which are respectively disclosed in U.S. Pat. No. 4,028,643, entitled "Waveguide Having Strip Dielectric Structure", which issued to T. Itoh on June 7, 1977 and U.S. Pat. No. 4,463,330, entitled "Dielectric Waveguide" which issued to T. Yoneyama on July 31. 1984.

In general, all of these offer significant savings in size and weight over the non-planar varieties. Further, monolithic and hybrid technologies are closely compatible with the planar configuration. Consequently, these technologies can be used to generate with higher producibility, systems which offer superior performance and enhanced reliability. When combined with high-volume batch fabrication, significant cost savings can result.

SUMMARY

This invention is directed to a multi-layer dielectric slab structure including a substrate layer and a guiding layer, with the substrate layer being bounded on the bottom side by a metal ground plane. A dielectric loading strip metallized on the top face comprises the top layer and forms the remainder of the structure. The layers of dielectric are primarily chosen with respect to their permittivities to keep the propagating energy away from the conductor surfaces, and thereby reduce conductor losses.

The conductive coating on the top surface of the dielectric loading strip permits single mode propagation over a relatively wide band and radiation losses due to coupling of the desired mode to the substrate modes are reduced and the polarization of the dominant mode is such as to render the structure of the transmission line relatively insensitive to small deviations from parallelism among the different interfaces of the structure. A whole family of devices evolves from such a structure including isolators to which this invention is directed.

DETAILED DESCRIPTION OF THE INVENTION

Before considering the preferred embodiments of the invention, the details and limitations of known prior art structures shown in FIGS. 1A through 1D and 2A and 2B will first be discussed.

The development of planar waveguiding structures for millimeter (mm)-wave applications has been proceeding for about two decades. An important concept in propagating energy in a waveguide is the notion of a mode. A mode is a spatial distribution of energy across the cross-section of the guiding structure. In general, a waveguiding structure can propagate several modes. Each of the modes has a characteristic cut-off frequency below which the waveguiding structure will not support it. It is customary to choose the cross sectional dimensions of the waveguiding structure such that, over the frequency range of interest, only one mode will be supported. This mode is often the one with the lowest cut-off frequency and is called the dominant mode and the cut-off frequency for the next higher order mode represents the useful bandwidth for the waveguiding structure. Accordingly, it is customary to design structures for the widest possible bandwidth consistent with single-mode operation as described above.

An important consideration in the design of a planar structure is the nature and behavior of the so-called substrate modes. These are undesirable parasitic modes which, if allowed to propagate, can cause severe transmission losses, especially at waveguide bends and discontinuities. Such consideration must be given attention over a wide range of geometric parameters, as well as over the entire operating frequency range. For example, in the non-radiative waveguide disclosed in the above referenced U.S. Pat. No. 4,463,330, Yoneyama, it is now established that small gaps, due to fabrication imperfections, between the metal planes and the dielectric materials leads to radiation loss. This occurs primarily because the electric field for the dominant mode is substantially parallel to the metal planes. It is desirable to establish the polarization of the dominant mode such that the electric field is largely normal to the metal planes. This is not possible with the nonradiative guide.

Similarly, the strip dielectric waveguide structure of Itoh, disclosed in the above referenced U.S. Pat. No. 4,028,643, also has limitations. For one, its dominant mode is actually an admixture of two orthogonal polarization states. Consequently, some leakage via coupling to the parasitic substrate modes is unavoidable. Further, this coupling grows stronger as one progresses to lower frequencies since then, the difference between the guiding structure and the region external to it cannot be distinguished by the propagating energy. Additionally, the structure has no inherent mechanism for propagating direct current energy.

Figure 1A:
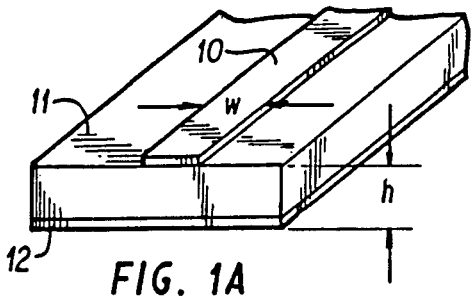
FIG. 1A PRIOR ART
FIG. 1A shows a perspective view of a known prior art microstrip line.
Figure 1B:
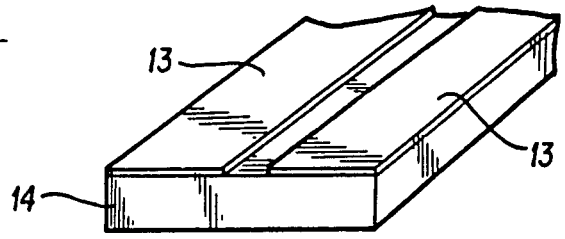
FIG. 1B PRIOR ART
FIG. 1B shows a perspective view of a known prior art slotline.
Figure 1C:
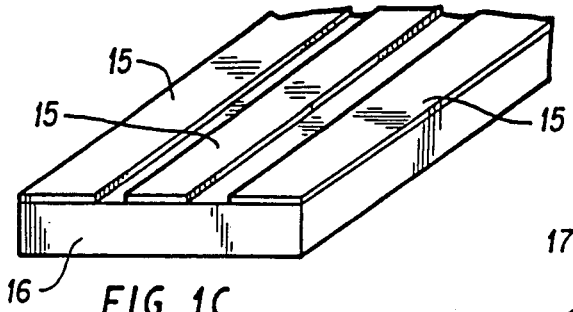
FIG. 1C PRIOR ART
FIG. 1C shows a perspective view of a known prior art coplanar waveguide.
Figure 1D:
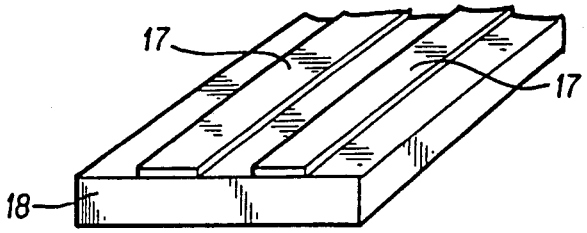
FIG. 1D PRIOR ART
FIG. 1D shows a perspective view of a known prior art coplanar strip.

Considering now the drawings, in the structures shown in FIG. 1A through 1D, which are illustrative of known prior art, metallic strips are of primary importance in the waveguiding process. In the microstrip line of FIG. 1A, a conducting strip 10 is mounted on a dielectric 11 which is coated on its bottom surface with a metallic ground plane 12. In the slotline of FIG. 1B, two parallel conductors 13 are placed upon dielectric 14. In FIG. 1C, a coplanar waveguide configuration is shown in which three parallel conductors 15 are placed on dielectric 16, the two outer conductive strips acting as a ground plane. In FIG. 1D, coplanar conductive strips 17 are mounted on dielectric 18, but the edges of the strips are not coextensive with the edges of the dielectric slab, as they were in the slotline of FIG. 1B.

The microstrip structure shown in FIG. 1A has proven the most versatile and successful among the prior art configurations using metallic strips. The microstrip type of transmission line has been successfully used in applications up to 60 GHz, but even at those frequencies, some of the problems associated with its use are evident. In microstrip, the substrate modes are suppressed by choosing a dielectric substrate that is thin enough. At 60 GHz, a typical substrate thickness must not exceed 8 mils. At higher frequencies, even thinner substrates must be used.

The requirement of thin substrates bears important consequences for the electrical and mechanical properties of the microstrip structure. The impedance of a transmission line in microstrip is primarily determined by the ratio of the conductor strip width W, to the dielectric thickness h, i.e. W/h. The value of W is bounded at the upper end by the requirement that it be small compared to the wavelength of the propagating energy at the frequency in question. The lower bound on W is determined by the accuracy and reproducibility with which a narrow line can be fabricated. These bounds in turn limit the range of line impedances available to the circuit designer. Consequently, the versatility of the structure is limited when very thin dielectric substrates are used.

Another serious problem is transmission line loss. In microstrip, this loss is dominated by the ohmic losses in the metal conductors. These losses inherently increase with frequency, and in microstrip, are made to increase even more rapidly as thinner dielectric substrates are used. A third problem is related to fabrication. The thin substrates required make for very delicate in-process handling. Such processing conditions can result in poor fabrication yields.

A fourth problem concerns the thermal properties of the structure. Ironically, this consideration leads to the conclusion that the substrate is not thin enough. If the dielectric substrate is a semiconductor on which truly planar transmitting sources are integrated, then the heat generated within these sources would have to be removed if the device is to survive operation. Unfortunately, most electrical insulators are also thermal insulators, diamond and beryllium oxide being exceptions, and consequently, the heat generating device would be thermally isolated from a heat sink, unless the substrate was made very thin.

Several attempts have been made to reduce the impact of the above drawbacks, by inserting these substrates into waveguide enclosures to form fin-line and suspended-substrate-stripline configurations. However, these structures are limited by the dimensions of the waveguide enclosures in which they are housed. Besides, the advantages of size and weight are compromised somewhat, and the thermal problem is left unaddressed. The shortcomings of microstrip are described in Pucel, R. A., "Design Considerations for Monolithic Microwave Circuits", IEEE Trans., Vol. MTT-29, no. 6, pp. 513–534, June, 1981.

Planar dielectric waveguides, on the other hand, offer more convenient substrate and guide dimensions, and also have low loss. Considering now FIGS. 2A and 2B, in FIG. 2A, a dielectric strip guide is shown in which a dielectric strip 19 is mounted on a dielectric slab 20 which is coated on its bottom surface with metallic ground plane 21. An inverted strip guide is shown in FIG. 2B in which a dielectric strip 22 is sandwiched between dielectric slab 23 and metallic ground plane 24. A key feature of planar dielectric structures is that they have very low loss at frequencies where the structures of FIG. 1A–FIG. 1D cannot be used at all. Thus, planar dielectric waveguides have been used at optical frequencies spanning the infrared to visible range. This is in part due to the outright absence of conductors or the relative remoteness of the conductor surfaces from the propagating energy.

Figure 3:
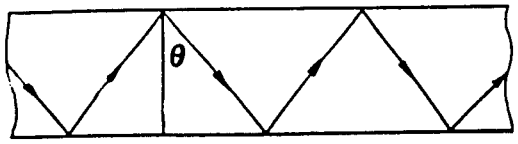
FIG. 3 is schematically illustrative of a guided wave mode in a slab type waveguide in accordance with the subject invention.

An elementary way of perceiving the guiding process is illustrated in FIG. 3. If light in an optically denser medium is incident on an interface with a relatively rarer medium, then total internal reflection off the interface occurs whenever the angle of incidence $\theta$ in the denser medium exceeds a certain critical angle. This critical angle is characteristic of the pair of materials forming the interface. If a slab of optically dense material, e.g. glass is sandwiched by optically rarer medium e.g. air, then waveguiding is possible by total internal reflection off both interfaces. The optically dense medium is called the guiding layer; the bounding rarer medium is called the cladding layer. The structure is appropriately called a slab waveguide.

Figure 2A:
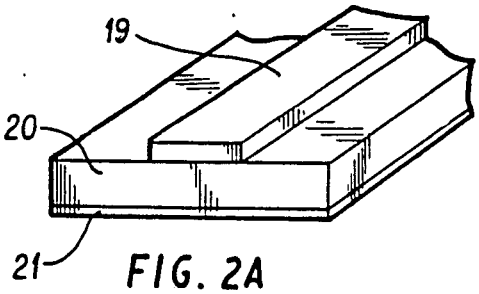
FIG. 2A PRIOR ART
FIG. 2A shows a perspective view of a known prior art dielectric strip guide.
Figure 2B:
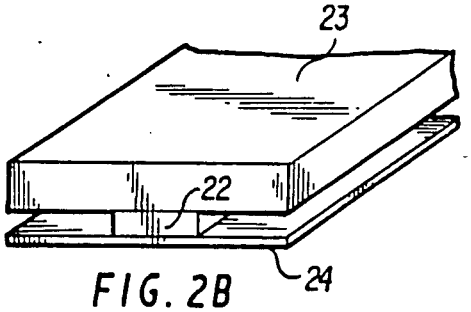
FIG. 2B PRIOR ART
FIG. 2B shows a perspective view of a known prior art inverted dielectric strip guide.

The planar dielectric structures of FIGS. 2A and 2B, however, suffer from the inherent limitation of being multi-modal in that they all support at least two modes. Any attempt to realize single mode operation usually results in a mode that is too weakly bound to the structure to be of any practical use. The very close separation in the cut-off frequencies between the dominant $TM_0$ mode and the next higher $TE_0$ mode forces either an acceptance of a very narrow band waveguiding structure, or a dual-mode guide. The coupling between these two modes can result in high radiation loss at discontinuities and bends, as well as increased coupling to the spurious substrate modes mentioned in connection with microstrip and dielectric strip waveguide.

A second disadvantage of planar dielectric structures is their extreme sensitivity to the condition of the interface. Thus, any roughness in the surfaces of the guiding or cladding media or any bubbles trapped between them during the bonding process can have a profound influence on the losses due to random scattering from these centers at the boundaries.

Figure 4:
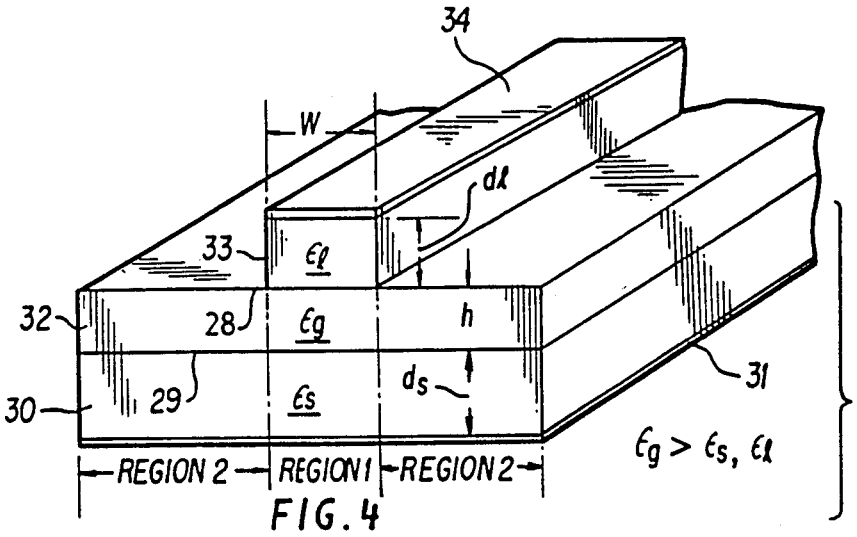
FIG. 4 shows a perspective view of one embodiment of a compound dielectric multi-conductor transmission line in accordance with this invention.

In view of the foregoing, the details of the various embodiments of this invention will now be considered. Referring now to FIG. 4, a substrate 30 whose permittivity is $\epsilon_s$ and whose thickness is $d_s$ is clad on one side, i.e. the bottom face, by a metal ground layer 31. The other side or top face of the substrate 30 is bonded to a dielectric guiding slab layer 32 whose permittivity is $\epsilon_g$ and whose thickness is h. A relatively narrower dielectric loading strip 33 of width W, thickness $d_l$ and permittivity $\epsilon_l$ is bonded to the other side or top face of guiding slab 32. The propagating direction for the electrical energy is along its longitudinal axis. The upper face of the loading strip 33 is clad with a relatively thin metal layer or coating 34, which covers at least one third of the width W of the loading strip and extends uniformly, periodically or aperiodically along its length depending on the needs of the user.

The permittivity $\epsilon_g$ of the guiding layer 32 is made to be greater than both the permittivity $\epsilon_s$ of the substrate 30 and the permittivity $\epsilon_l$ of strip 33 due to the fact that energy being propagated seeks the medium with the highest permittivity. The nature and thickness of metal ground layer 31 and metal cladding layer 34 are not critical. A waveguide structure in accordance with the configuration shown in FIG. 4 was constructed with a guiding slab layer 32 of RT "Duroid" 6010 and both the substrate dielectric 30 and strip 33 of alumina. "Duroid" is a trademark of Rogers Corp. for filled tetrafluoroeythylene material. The permittivities and dimensions were as follows:

$$\epsilon_g = 10.6\ \epsilon_0$$

$$\epsilon_l = \epsilon_s = 9.7\ \epsilon_0$$

where $\epsilon_0$ is the permittivity of free space, and $h = 0.025''$ $d_l = d_s = 0.020''$ When the permittivities of the substrate 30 and strip 33 are equal, $\epsilon_l = \epsilon_s$ the preferred ratio between each of the thicknesses $d_s$ and $d_l$ of the substrate and strip and that of the guiding slab layer h is approximately 0.75. In the example described above, for practical reasons the thickness ratio was altered to 0.8.

The line loss in this waveguide was measured at 94 GHz and was found to be only 0.4 db/inch, compared with a loss of 2.5 db/inch at that frequency for microstrip, an improvement of almost six to one.

The transmission line of FIG. 4 combines the wideband feature of microstrip and the low loss characteristic of planar dielectric waveguides. Like the planar dielectric waveguide, it has no "sidewalls" so that scattering losses are reduced. Ohmic conductor losses are reduced substantially below those in an equivalent microstrip structure, permitting operation at higher frequencies. Further, the amount by which they are reduced increases as the frequency is increased. In the example presented, the conductor losses are 56% of their microstrip contributions at 75 GHz. At 100 GHz, they are 33% of their microstrip contributions. This is a significant result since conductor losses are known to increase with increasing frequency.

It was earlier remarked that in the planar dielectric waveguide, including the strip-loaded guide, the dominant $TM_0$ mode is not widely separated from the $TE_0$ mode. The addition of metal conductors 31 and 34 in the manner shown is particularly significant in the instant invention in that the separation between these modes is widened, thus permitting single-mode operation over a wider band. The actual separation is determined by the ratio $h/(d_s+d_l)$ i.e., a larger ratio results in a wider separation between the modes and hence, a wider operating bandwidth independent of the dielectric materials chosen so long as $\epsilon_s = \epsilon_l$. The condition for mode separation is somewhat more complicated but nevertheless calculable when $\epsilon_s \neq \epsilon_l$. In either case the dominant mode is the $TM_0$ mode whose polarization is such that the electric field is largely at right angles to the metal conductors as required. This entire phenomenon was not previously anticipated. Also, the top conducting strip 34 serves as a reflector to confine the propagating energy to region 1 of the dielectric layers even at low frequencies. The substrate modes in the "wings" of the structure (region 2) have no such confinement means. Consequently, the effective dielectric constant of the wings will decrease with frequency whereas it will remain substantially constant in the region under the strip. This difference in the effective dielectric constants is what produces the confinement of the propagating energy which will therefore be well guided even at low frequencies and dc.

The thickness of the microstrip substrate 11 of the known prior structure shown in FIG. 1 is limited because of the need to suppress the spurious substrate modes, as indicated previously. The most troublesome among these modes is the $TE_0$ mode for a grounded dielectric slab. The structure shown in FIG. 4, on the other hand, suppresses the propagation of this $TE_0$ mode, thus permitting the use of thicker substrates 30 at a given operating frequency than would be possible with a comparable microstrip guide. As a result, losses at waveguide bends and waveguide discontinuities will be greatly reduced.

As illustrated by the foregoing example, the dimensions of the waveguide (FIG. 4) at the frequency range of 75–100 GHz will be larger than those of a microstrip structure (FIG. 1) designed for that range. The choice of the guiding layer 32 thickness h, the substrate dielectric 30 thickness $d_s$, and the loading strip 33 thickness $d_l$, are determined by the desired frequency of operation and by the dielectric permittivities $\epsilon_g$, $\epsilon_s$ and $\epsilon_l$. At a given frequency, a larger difference $\epsilon_g-\epsilon_s$ or $\epsilon_g-\epsilon_l$ will lead to smaller values of h, $d_s$ and $d_l$, respectively. For example, if $\epsilon_s=\epsilon_l=6.6\ \epsilon_0$ which corresponds to BeO, and $\epsilon_g=12.9\ \epsilon_0$ which corresponds to GaAs, then h $=0.012''$ and $d_s=d_l=0.010''$ in order to yield a waveguiding structure of identical performance to the one quoted in the foregoing example. Thus, the advantage of thicker substrate material is surrendered somewhat if a large dielectric discontinuity exists at the relevant interfaces.

Any or all of the dielectric elements 30, 32 and 33 of the structure shown in FIG. 4 may be semiconductors. Another unexpected result that emerges from a consideration of the new structure, particularly when semiconductors are used, is a method for exciting the dominant mode. The conventional shunt and series excitation in microstrip line are well known. In the present guide of the present invention, however, another excitation method exists. The excitation source may be located at the interface 29 between guiding layer 32 and substrate dielectric 30 or at the interface 28 between guiding layer 32 and strip 33. The excitation source would be oriented with its current transport direction parallel to the desired direction of propagation of the energy i.e. parallel to the longitudinal axis of the strip.

This method of excitation is useful because: (i) the interface 29 or 28 is the natural location of a device integrated on a semiconductor guiding layer 32; and (ii) substrate 30 and strip 33 would provide dc isolation of transmission line conductors 31 and 34 from such a device. This is a convenient feature which adds to the design flexibility of the structure.

In many respects, the transmission line of FIG. 4 resembles microstrip with the closeness of the resemblance under the designer's control. At low frequencies, its behavior is identical to microstrip. In effect, the structure of the present invention may be viewed as a means to extend the frequency of operation of microstrip circuits without having to change the substrate thickness. Thus, a 70 mil thick conventional microstrip configuration is only usable from dc to 14 GHz while the 70 mil compound dielectric slab in accordance with the invention and as presented in the design example above is usable from dc to 100 GHz.

The characteristic impedance of the transmission line shown in FIG. 4 is determined primarily by the ratio of the width W of the loading strip 33 to the effective guiding layer thickness, (which is always somewhat larger than the actual thickness h), when the width is small compared to the wavelength. Changes in width W can also be used to provide impedance matching and frequency filtering. For widths comparable to or larger than the wavelength, no complicated field analysis is required to define the impedance level, which is dependent on the operating frequency. However, this change need not be very large. In the design example presented, a 50Ω line at 75 GHz becomes a 64Ω line at 100 GHz. Smaller variations in impedance are possible with alternative designs at the cost of higher line loss.

In the structure of FIG. 4, an appreciable amount of energy is propagated in the guiding and the substrate layers 32 and 30 where no "sidewall" losses are manifested. A smaller proportion of energy is present in the loading strip 33. This energy, however, is subjected to sidewall scattering loss. Besides, the fields at the edge of the conducting strip 34 are relatively higher, so that the scattering losses could be greater.

Figure 5:
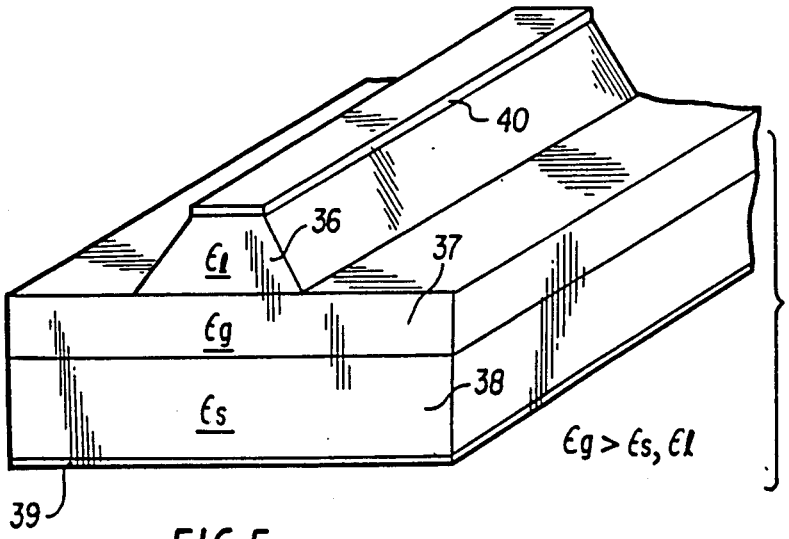
FIG. 5 shows a perspective view of an alternative embodiment of the transmission line shown in FIG. 4.

A solution to this problem is to taper the sides of the dielectric loading strip 33 so that its cross section is no longer rectangular. FIG. 5 shows the special case of a symmetric linear taper so that loading strip 36 has the cross section of an isoceles trapezoid. The rest of the configuration is similar to that previously described with respect to FIG. 4. Strip 36 rests on guiding slab layer 37 which is in turn mounted on substrate dielectric layer 38. Ground plane 39 is coated on the bottom of layer 38 while a metal cladding layer 40 is formed on the top surface of the tapered loading strip 36. A variety of other tapers may also be used for strip 36 such as concave and convex circular, concave and convex hyperbolic, exponential, etc.

The technique of tapering the strip 36 has some additional latent advantages: (i) It permits a wider range of conductor linewidths and can be realized without running into the mechanical difficulty of having to mount very thin strips edge-on on the guiding layer; (ii) The tapered sides "soften" the discontinuity at the strip's edge. This has the effect of focusing the energy towards the center of the strip. This focusing effect is increased if the taper is such that the slope at any point on it relative to the vertical is greater than the critical angle for that interface. The tapered sides also increase the separation between $TE_0$ and $TM_0$ modes beyond the effect previously described. Thus, a wider operating bandwidth is permitted. Alternatively, for a given operating bandwidth, the conductor losses may be reduced even further.

One of the anticipated disadvantages is the sensitivity of the propagating energy to imperfections of the tapered sides. This is expected to be more critical for high impedance (narrow conductor width) lines. However, such sensitivity will have a smaller impact than any corresponding effect in a competitive planar dielectric waveguide. The wide bandwidth afforded by the waveguide of this invention makes the medium ideally suited for digital transmission.

Additionally, one or more of the dielectric layers 30, 32, 33 of FIG. 4 may be replaced by a non-reciprocal medium, including, for example, a ferroelectric or ferrimagnetic material such as Barium titanate or a ferrite. The relatively small volumes in which the propagating waves are confined would enable one to use smaller amounts of control energy, and yet maintain the control energy density (energy/volume) at high enough levels to manipulate the guided energy. In practice, this means that one may use smaller magnetic field strengths to manipulate the high-frequency energy in devices such as ferrite phase shifters and modulators as well as in circulators and isolators.

The heat dissipation problem outlined earlier can be more effectively overcome by using materials, such as BeO, that are electrical insulators but thermal conductors for the substrate dielectric and/or dielectric strip. Since these materials can be brought in direct contact with the power-generating device, they can serve as a low thermal resistance path between the device and a heat sink.

This now leads to a consideration of the family of devices shown in FIGS. 6 through 20.

Figure 6:
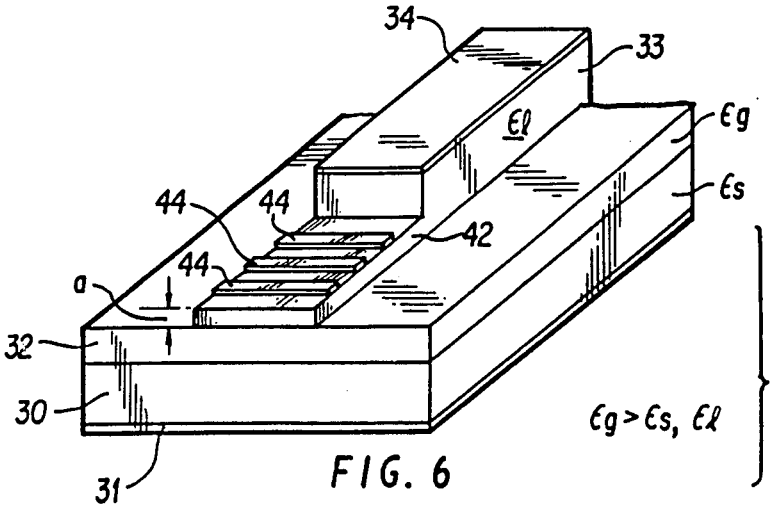
FIG. 6 is a perspective view illustrative of a first embodiment of an antenna constructed in accordance with the waveguide structure shown in FIG. 4.
Figure 7:
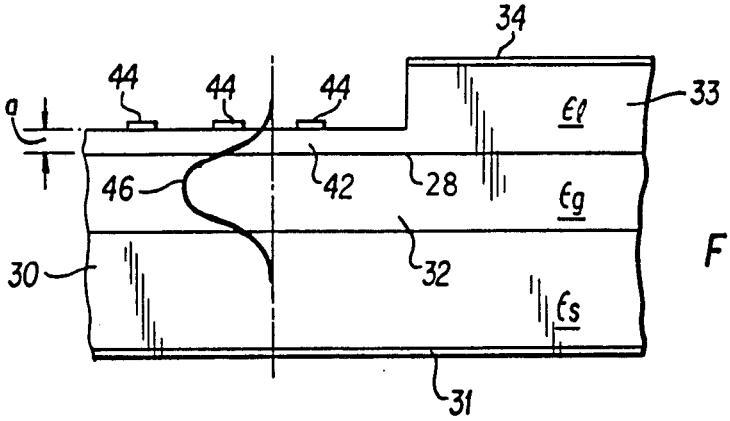
FIG. 7 is a cross-sectional view of the antenna shown in FIG. 6 taken along the lines 7—7 thereof and further illustrates the energy distribution across the interface of the dielectric layers to cause radiation.
Figure 8:
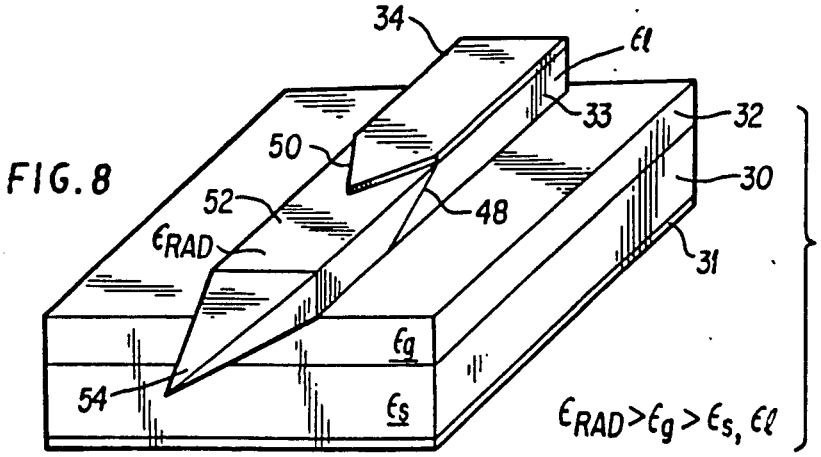
FIG. 8 is a perspective view illustrative of a second embodiment of the antenna configured from the transmission line shown in FIG. 5.

Antenna arrays are widely used in microwave and millimeter wave ground based and airborne systems. Planar arrays are attractive for airborne applications because of their lightweight structural compatability and low cost. Accordingly, FIGS. 6 and 8 are illustrative of two embodiments of antennas which can be configured from the basic transmission line structure shown in FIG. 4. As shown in FIG. 6, the dielectric loading strip 33 on top of the guiding layer 32 includes an abrupt transition to a region 42 of reduced thickness a which includes a plurality of transverse metal lines or strips 44 formed on the top surface thereof and which operate as a diffraction grating. Due to the fact that energy propagated in the guiding layer 32 has a distribution pattern across its thickness as shown by reference numeral 46 of FIG. 7, part of the energy couples to the adjoining regions of the loading strip 33 and the substrate 30, which if the thickness dimension is properly chosen, then sufficient energy exists in the region 42 to be radiated from the diffraction grating in a well known manner. While the transition in the loading strip 33 of FIG. 6 is shown as a step, the transition, when desirable, can be sloped and/or the grating element 44 can be formed in different shapes with the width and spacing of these elements being either periodic or aperiodic depending upon the desired radiation pattern.

Also, the reduced region 42 can be made of a different dielectric which leads to consideration of the embodiment shown in FIG. 8. There a linear tapered transition of both the dielectric loading strip 33 as well as the top layer of metallization 34 is provided as shown by reference numerals 48 and 50, respectively, with a pointed radiator element comprised of dielectric having a permittivity $\epsilon_{rad}$ being provided as an extension of the layer 33. The permittivity $\epsilon_{rad}$ of the radiating element 52 is made to be greater than the permittivities of both the guiding layer 32 as well as the permittivities $\epsilon_s$ and $\epsilon_l$ of the layers 30 and 33. Since energy propagating in the transmission line seeks the highest dielectric medium, the radiating element 52 in effect lifts the guided mode off of the guiding layer 32. The radiating element 52 as shown also includes a tapered nose section 54 so as to efficiently radiate energy to free space or alternatively, to couple energy efficiently from free space into the transmission line.

When desirable, the element 52 can be configured to include a suitable corrugation grid pattern or a combination thereof in a manner shown in FIG. 6. It may also be possible to fabricate the radiating element 52 from materials which are alterable electronically so as to alter the direction of radiation and thereby provide a scanning mode.

Figure 9:
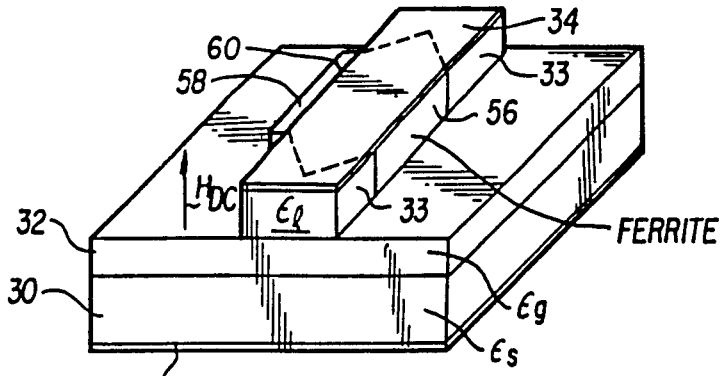
FIG. 9 is a perspective view illustrative of a first embodiment of an isolator device configured from the transmission line shown in FIG. 4.
Figure 10:
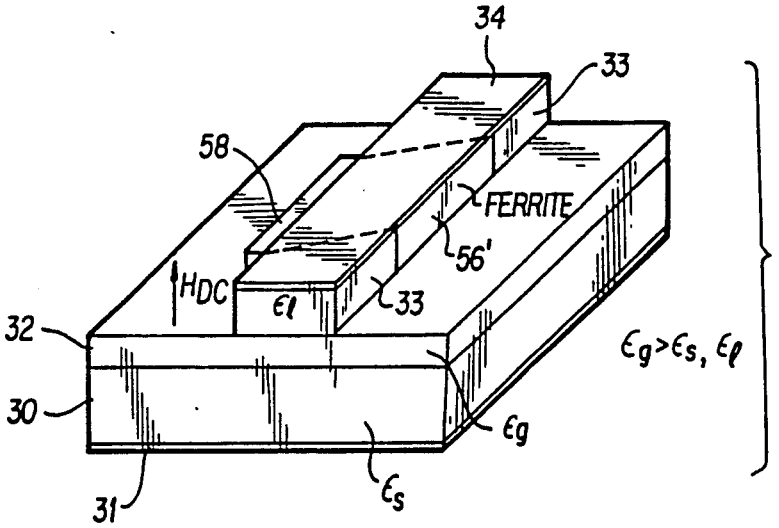
FIG. 10 is a perspective view illustrative of a second embodiment of an isolator device constructed from the embodiment of the transmission line shown in FIG. 4.

Turning attention now to the embodiments shown in FIGS. 9 and 10, shown thereat are two configurations of a device known as a signal isolator which permits the flow of a signal in one direction but not in the other direction. This is provided by the inclusion of a section of an anisotropic material such as a ferrite or electro-optic medium into the transmission line structure of FIG. 4. As shown in FIG. 9, a section 56 of magnetically biased ferrite which is tapered at both ends is inserted in the length of dielectric loading strip 33 beneath the outer layer of metallization 34. The taper is for providing an impedance match between ferrite material of the section 56 and the dielectric material of the loading strip 33. A generally rectangular slab 58 of lossy absorber material is affixed to one side 60 of the ferrite section 56, the purpose of which will be considered subsequently.

A second embodiment of an isolator device is shown in FIG. 10 and differs from the embodiment shown in FIG. 9 in the shape of the ferrite section included along the length of the dielectric strip 33. As shown, a section 56' of ferrite material having a sloped type of transition is included.

Figure 11A:
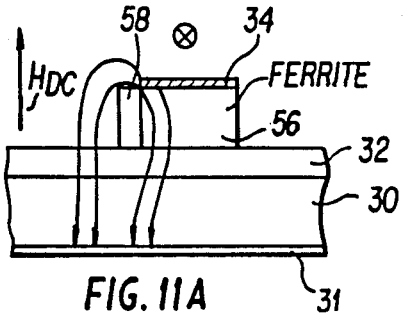
FIGS. 11A and 11B are schematic diagrams helpful in understanding the operation of the isolator device as shown in FIGS. 9 and 10.
Figure 11B:
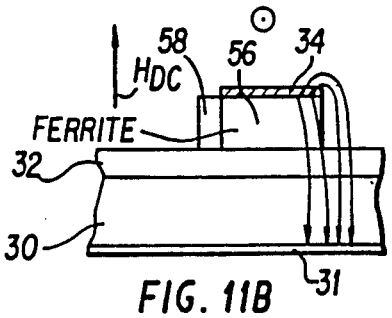

These devices operate in the following manner. For isotropic material, under normal operation, the electromagnetic field is distributed symmetrically with respect to the cross section of any transmission line. However, when an anisotropic material is inserted into the structure and is suitably biased by a magnetic field $H_{dc}$, the field crowds towards one edge of the line for a wave propagating in the guiding layer 32 in one direction, but crowds towards the other edge when the direction of propagation is reversed, as shown in FIGS. 11A and 11B. Accordingly, means for generating a magnetic biasing dc field $H_{dc}$ and which may be comprised of electromagnets, not shown, applies the magnetic field upwardly through the dielectric layers 30, 32 and 33 as well as the ferrite section 56 and 56' and the energy propagating along the line will be crowded towards the slab 58 of absorber material in one direction as shown in FIG. 11 while being crowded toward the opposite edge for energy propagation in the opposite direction. Thus energy will be absorbed strongly in one direction of propagation and not so for the reverse direction, thus providing a device which is commonly known as an isolator.

Additional impedance matching and bandwidth requirements may be met by including a stepped or gradual discontinuity in the height of the ferrite sections 56 and 56' relative to that of the dielectric layer 33.

Figure 12:
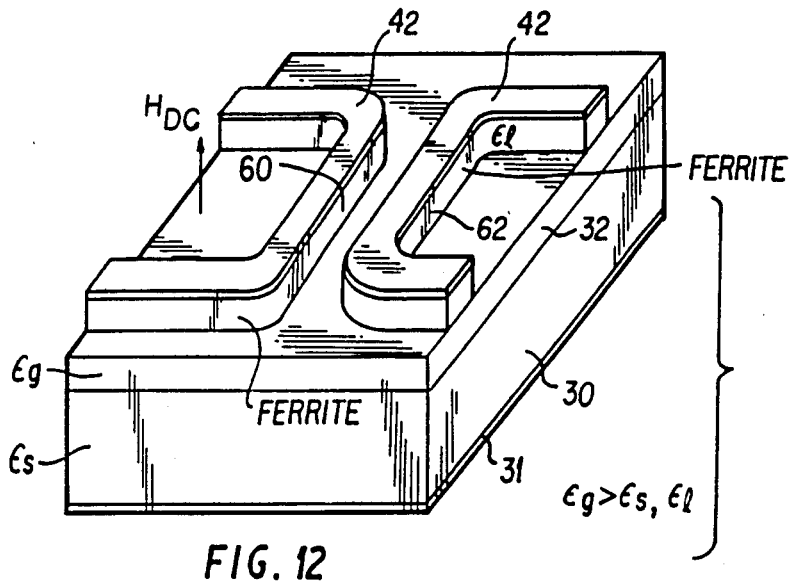
FIG. 12 is a perspective view illustrative of a circulator type of coupling device configured from the transmission line shown in FIG. 4.

In view of the characteristic of anisotropic material, such as ferrite which when suitably biased by a magnetic field causes the propagating field to crowd at one edge of the line for a wave propagating in one direction and crowds at the other edge when the direction of propagation is reversed, this asymmetric field crowding can also be used to realize a device which is known as a circulator. A four port circulator configured in accordance with the subject invention is shown in FIG. 12. There a pair of ferrite strips 60 and 62 shaped in the form of back to back U-shaped elements and having outer layers of metallization 42 formed thereon are bonded to the upper surface of the dielectric layer 32 in relatively close proximity to each other. The ferrite strips 60 and 62 have a spacing P over a length L so that energy being guided beneath the strips 60 and 62 in the guiding layer 32 can be cross coupled.

Figure 13:
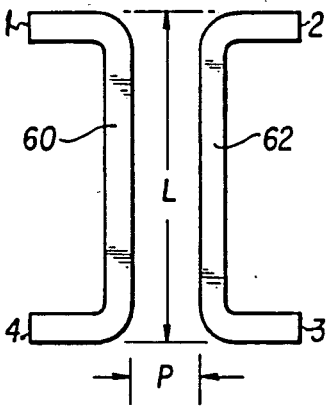
FIG. 13 is a schematic diagram illustrative of the pattern of the top loading strips formed on the device shown in FIG. 12.

As schematically shown in FIG. 13, the ferrite strip 60 as well as the underlying guiding layer 32 and substrate layer 30, not shown, terminate in upper and lower port signals 2 and 3. It is a well known property that waves traveling in one direction along a transmission line excite waves which then travel in the opposite direction in another line which is electromagnetically coupled thereto. If a biased anisotropic material is used, e.g. ferrite, the asymmetric field distribution produces strong coupling between the lines for signal waves traveling in only one direction. Thus in the configuration shown in FIG. 12, for a magnetic biasing field $H_{dc}$ in a first predetermined direction, it will cause a wave entering port 1 to travel along the guiding layer 32 under the ferrite strip 60 to be inwardly crowded adjacent the portion of the guiding layer underlying the strip 62 and will be coupled to port 2 if the dimensions P and L are adjusted properly. However, a wave entering port 2 and propagating along the guiding layer 32 will have its field crowded at the edge remote from strip 60 and energy will emerge at port 3. Similarly a wave entering port 3 will emerge at port 4 and that entering port 4 will emerge at port 1.

Therefore, what is provided is a circulator which will act as a clockwise "turnstile" for energy. By reversing the polarity of $H_{dc}$, the direction of circulation is reversed. By including means, not shown, providing a gradual reversal of $H_{dc}$ in response to a control signal a modulator results while an abrupt reversal, on the other hand, results in a switch.

Thus the isolator embodiment (FIGS. 9 and 10) can with reversal of the biasing magnetic field become a single-pole, single-throw switch while the circulator (FIG. 12) becomes a double-pole, double-throw switch.

Figure 14:
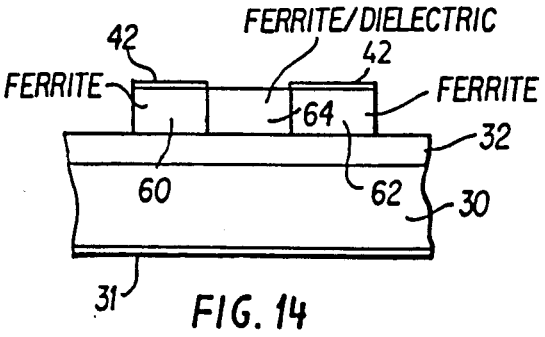
FIG. 14 is a partial cross sectional view illustrative of a modification of the embodiment shown in FIG. 12.

In order to adjust the degree of coupling of energy propagating along the guiding layer 32 underlying the parallel ferrite strips 60 and 62, one may add a contiguous section 64 of ferrite or a dielectric between the parallel segments 60 and 62 as shown in FIG. 14.

Figure 15:
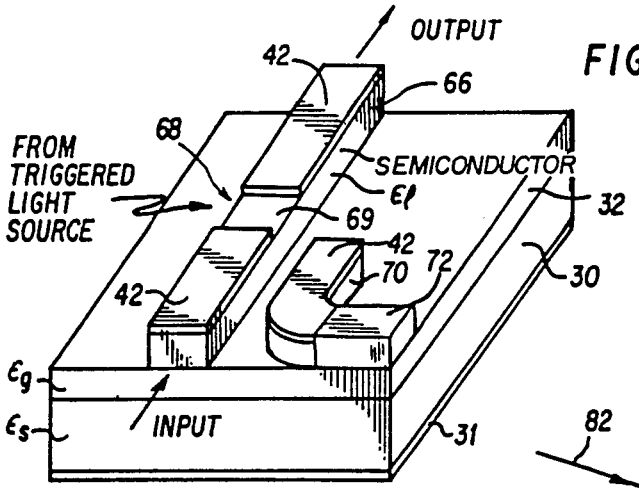
FIG. 15 is a perspective view illustrative of an optically controlled switch device formed in accordance with the transmission line shown in FIG. 4.

It should also be noted that semiconductor materials can be used as one of the layers such as the loading layer 33, in the transmission line structure shown in FIG. 4. This now leads to a consideration of FIG. 15 where there is disclosed an embodiment of an optically triggered switch device including a semiconductor member as one of the elements between the outer metallized layers 31 and 42. As shown in FIG. 15, a loading strip 66 of semiconductor material having dimensions similar to the dielectric loading strip 33 (FIG. 4), is affixed to the top surface of the dielectric guiding layer 32; however, a gap 68 is formed in the top metallization 42 where light from a triggered light source, not shown, is directed to and impinges on the semiconductor strip at 69. Adjacent the semiconductor loading strip 66 is a relatively short arm member 70 of semiconductor material also coated with a top layer of metallization 42 and which is terminated at one end in a lossy load member 72. The arm is placed adjacent the semiconductor member 66 on the input side of the gap 68 and the dielectric or the semiconductor strip 66 is selected such that without the metallization 42, the waveguide is effectively open, i.e. cut-off to millimeter waves propagating in the guiding layer 32; however, when the gap 68 is illuminated with light of suitable wavelength, a hole-electron plasma is generated at the upper surface 69 which bridges the gap in the metallization 42 so that the waveguide is no longer cut off and transmits millimeter wave energy in the underlying guiding layer 32 past the gap 68. In the absence of incident light at the gap 68, input millimeter wave energy is reflected back from the gap 68 where it is coupled to the side arm region including member 70 into the load 72 while the waveguide is in a cut-off state.

Alternately, the semiconductor material of the strip 66 can be chosen so that there is no cut-off condition. In this instance, the intensity and/or position of the optical beam directed to the gap 68 is used to modulate the amplitude and/or the phase of the millimeter wave propagating beneath the strip 66.

Thus semiconductor materials can be used as one or more of the layers. This even includes the guiding layer 32. Furthermore, active and passive sources can be integrated into the semiconductor. Active devices should be aligned so that their current path is colinear with the long axis of the transmission line in order that energy may be effectively coupled to and from the line. The waveguide structure of the subject invention thus has the potential for realizing complete circuit and system functions on a single semiconductor wafer; in other words, it is compatible with monolithic integration.

Figure 16:
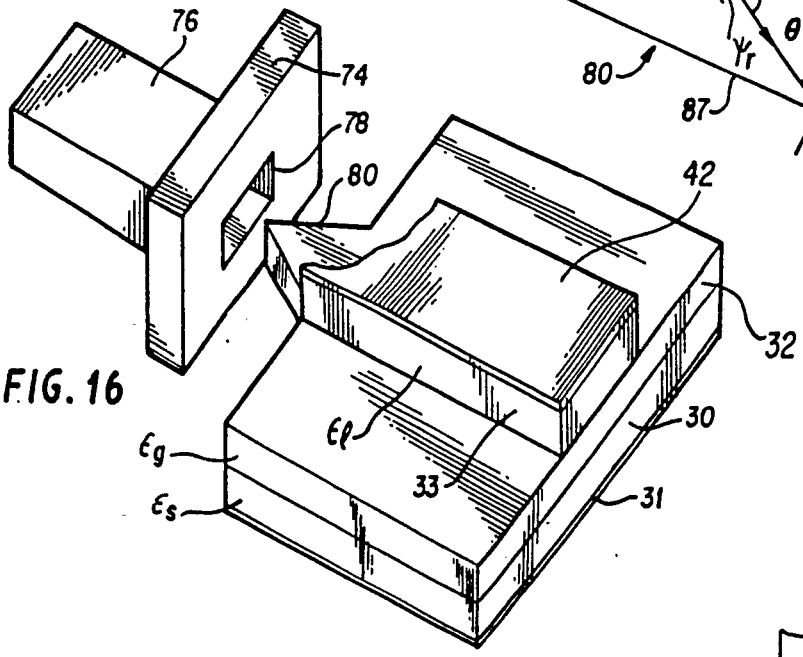
FIG. 16 is a perspective view illustrative of a device for providing a transition from rectangular waveguide to the subject transmission line as shown in FIG. 4.

Since it is necessary in some instances to couple energy to and from other types of transmission lines and/or external devices, transitions and/or coupling devices are required for the type of transmission line structure shown in FIG. 4. One such transition is shown in FIG. 16 and comprises a transition for use in connection with rectangular waveguide. As shown in FIG. 16, the flange 74 of a piece of rectangular waveguide 76 includes a rectangular aperture 78 which is adapted to receive an outwardly projecting tapered wedge section 80 of the guiding layer 32 which is designed to fit into the interior of the waveguide 76 via the aperture 78. The principle of energy coupling is furthermore illustrated in FIG. 17.

Figure 17:
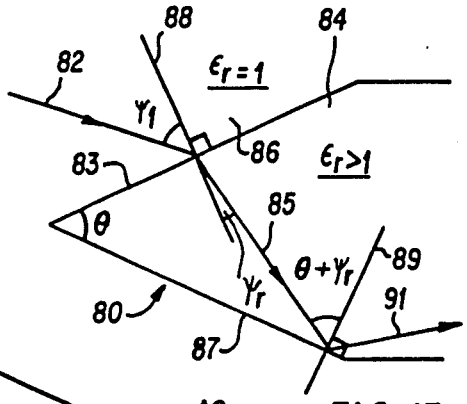
FIGS. 17 and 18 are schematic diagrams helpful in understanding the operation of the transition device shown in FIG. 16.

Referring now to FIG. 17, if a ray designated by reference numeral 82 is incident at an interface 83 of two dielectric media 84 and 86 where the relative dielectric permittivity $\epsilon_r$ of one, for example, media 84 is greater than the other, shown as unity in FIG. 17, then the ray 82, having an incident angle $\Psi_i$ relative to the normal 88 of the interface will be refracted as the ray 85 at an angle $\Psi_r$ and wherein $\Psi_r$ is less than $\Psi_i$ according to the Snell formula:

$$\sin\psi_i = \sqrt{\epsilon_r}\,\sin\psi_r$$

where the dielectric media 84 has a shape corresponding to the tapered wedge section 80 and consisting of two converging interface surfaces then the refracted ray 85 encounters a second interface 87 of the same two materials except that this interface is at an inclination angle $\theta$ relative to the first interface 83. Consequently, the refracted ray 85 has an incident angle of $\theta+\Psi_r$ relative to the normal 89. Since permittivity of the medium 84 is known to be greater than 1 while the permittivity of the medium 86 is unity, total internal reflection as shown by the ray 91 will occur if:

$$\theta + \psi_r > \theta_c = \sin^{-1}(1/\sqrt{\epsilon_r})$$

where $\theta_c$ is the critical angle. If $\Psi_{i\,min}$ denotes the smallest incident angle $\Psi_i$ for which total internal reflection occurs, then for all angles greater than $\theta_c$, all incident energy will then be confined to the medium 84, which in the embodiment shown in FIG. 16 comprises the guiding layer 32.

Figure 18:
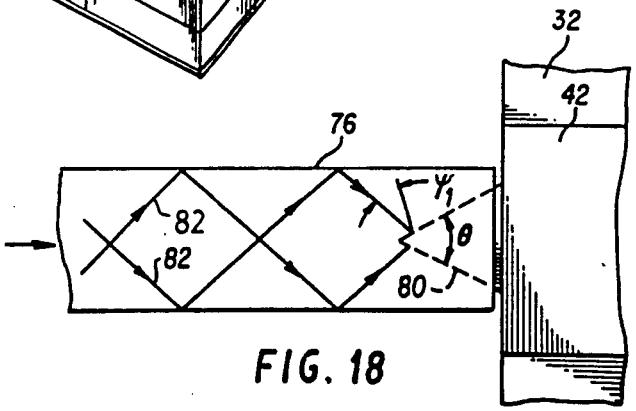

Referring briefly to FIG. 18, shown schematically is the propagation of energy in the rectangular waveguide 76 for the dominant mode. The positioning of the wedge 80 of the dielectric layer 32 is shown inserted therein such that its plane is parallel to the broadwalls of the rectangular waveguide 76. Considering the discussion with respect to FIG. 17, the energy propagating in the waveguide 17 will be launched onto the guiding layer 32 through the tapered section 80 since the dominant mode in rectangular waveguide may be considered as a superposition of two criss-crossing rays 82. The angles between these two rays change with the frequency and accordingly, the useful operating bandwidth defines a range of angles $\Psi_i$. For a given dielectric, one can therefore define $\theta$ such that coupling will occur for the smallest value of $\Psi_i$.

Figure 19:
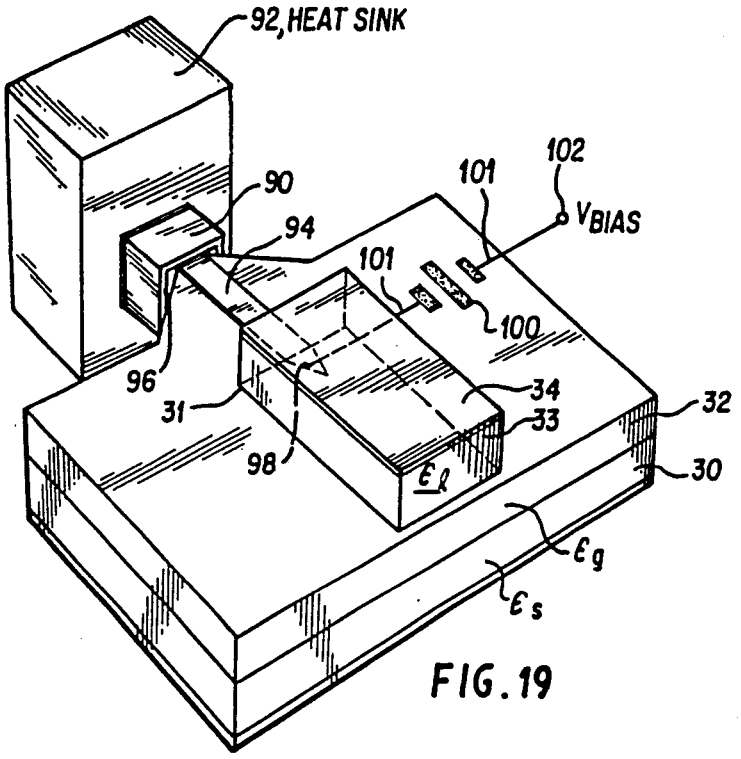
FIG. 19 is a perspective view illustrative of an embodiment for providing efficient coupling of power generated in an external device into the waveguide structure as shown in FIG. 4.
Figure 20:
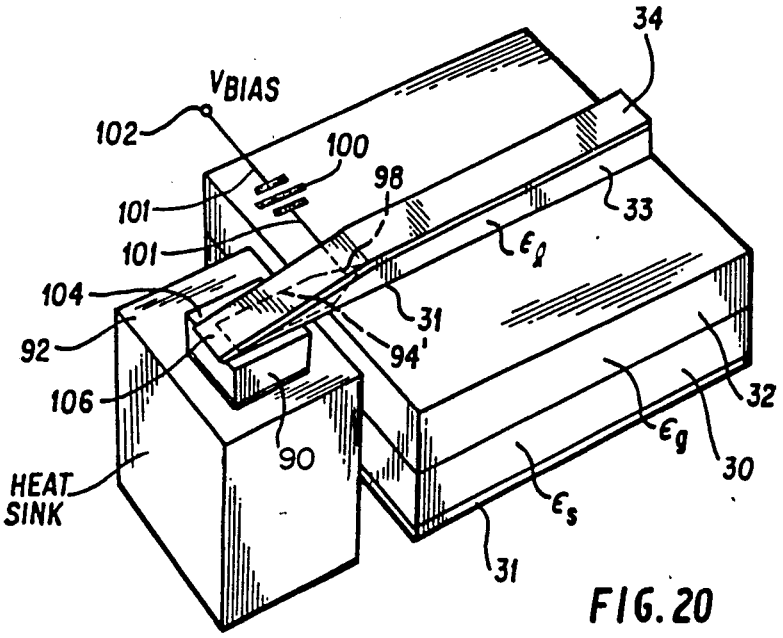
FIG. 20 is a perspective view illustrative of another embodiment of a configuration of coupling power generated in an external device into the transmission line structure shown in FIG. 4.

Considering now the FIGS. 19 and 20, shown thereat are two embodiments for coupling power between external power source devices and the waveguide structure of the present invention. With reference to FIG. 19, an active device 90 is shown mounted on one side surface of a heat sink 92. Coupling to the dielectric guiding layer 32 is provided by a right-angled strip of metallization 94 which is formed over the face 96 of the active device 90 and onto the top surface of the guiding layer 32 where it extends under the bottom face of the loading strip 33 and terminating in a taper 98 as shown to provide an impedance match. Additionally, a bias filter comprised of a pattern 100 of metallization consisting of wide and narrow sections of metal are formed on the top surface of the guiding layer 32 which are coupled by conductor line segments 101 between the tip 98 of the metallization strip 94 and a bias voltage source, not shown, coupled to terminal 102. The tapered strip of metallization 94 in effect acts like a metallized antenna which is inserted into the interface 31 between the guiding layer 32 and the loading strip 33 to radiate energy into the guiding layer 32 of the transmission line in the desired mode. When desired, the metallization strip 94 can be configured into a grating to maximize coupling to the device.

The embodiment shown in FIG. 20, on the other hand, is illustrative of a configuration wherein the active device 90 is mounted on the top surface of the heat sink 92, in which case coupling between the active device 90 and the guiding dielectric layer 32 is made simply by a planar section of metallization 94' extending from the top surface 104 of the active device to the interface 31 between the dielectric layers 32 and 33. The metallization 94' additionally includes a tapered end section 106 over the active device 90. As in the embodiment shown in FIG. 19, the bias filter 100 is again coupled between bias voltage terminal 102 and the tapered tip 98 of the metallization strip 94' by segments of a line conductor 101.

Thus what has been shown and described is a slab type of structure for a millimeter wave transmission line including a family of devices which is realizable therefrom.

The examples described above are only illustrative of the specific embodiments of the invention and accordingly various other modifications will suggest themselves to those skilled in the art. Therefore, all modifications, alterations and changes coming within the spirit and scope of the invention are herein meant to be included.

I claim:

1. A transmission line structure implementing a signal isolator comprising:

(a) a dielectric substrate layer of predetermined thickness $d_s$ and permittivity $\epsilon_s$, and having top and bottom parallel surfaces;

(b) a conductive ground plane on the bottom surface of said substrate layer;

(c) a dielectric guiding slab layer coextensive with said substrate layer and being of predetermined thickness h and permittivity $\epsilon_g$, where $\epsilon_g > \epsilon_s$, and having top and bottom parallel surfaces and attached to said substrate layer with the bottom surface of said guiding slab layer attached to the top surface of said substrate layer;

(d) at least one elongated dielectric loading strip layer having a width substantially less than the width of said substrate and guiding slab layers and being of a thickness $d_l$ and permittivity $\epsilon_l$, where $\epsilon_l \leqq \epsilon_g$, and having top and bottom parallel surfaces, said bottom surface being attached to the top surface of said guiding slab layer;

(e) a section of anisotropic material selectively located in said loading strip layer along its length;

(f) a section of energy absorber material located adjacent one side surface of said section of anisotropic material whereby energy propagation in one direction will be crowded toward said one side surface and be absorbed by said absorber material while energy propagation in the other direction will be crowded toward the other side surface of said section of anisotropic material and will propagate normally; and (g) a conductive coating on said top surface of said loading strip layer, whereby single mode propagation is permitted over a relatively wide band and radiation losses due to coupling of the desired mode to the substrate modes and the conductors are reduced and the polarization of the dominant mode is such as to render said structure relatively insensitive to small deviations from parallelism among the different interfaces.

2. The transmission line structure of claim 1 wherein said section of anisotropic material comprises a section of magnetically biased ferrite material.

3. The transmission line structure of claim 1 wherein said section of anisotropic material comprises an electro-optical medium.

4. The transmission line structure of claim 1 wherein said section of anisotropic material includes a taper for providing an impedance match between said section of anisotropic material and said dielectric loading strip layer.

5. The transmission line structure of claim 4 wherein said section of anisotropic material is tapered at both ends.

6. The transmission line structure of claim 1 wherein said section of anisotropic material includes an angulated end surface in contact with said loading strip layer for providing an impedance match between said section of anisotropic material and said dielectric loading strip layer.

7. The transmission line structure of claim 6 wherein said section of anisotropic material includes an angulated end surface at both ends of said section.

* * * * *